US006755257B2

(12) United States Patent
Spencer et al.

(10) Patent No.: US 6,755,257 B2
(45) Date of Patent: Jun. 29, 2004

(54) DRILLPIPE ASSEMBLY AND A METHOD OF DEPLOYING A LOGGING TOOL

(75) Inventors: Michael Charles Spencer, Melton Mowbray (GB); Simon Christopher Ash, Newark (GB); Michael John Chaplain, Nuneaton (GB)

(73) Assignee: Reeves Wireline Technologies Limited, Loughborough (GB)

( * ) Notice: Subject to any disclaimer, the term of this patent is extended or adjusted under 35 U.S.C. 154(b) by 0 days.

(21) Appl. No.: 10/071,606

(22) Filed: Feb. 8, 2002

(65) Prior Publication Data

US 2002/0117300 A1 Aug. 29, 2002

(30) Foreign Application Priority Data

Feb. 9, 2001 (GB) ..... 0103191

(51) Int. Cl.[7] ..... E21B 47/00
(52) U.S. Cl. ..... 166/383; 166/66; 166/254.2
(58) Field of Search ..... 166/254.2, 383, 166/255.1, 382, 66, 65.1, 113, 241.5

(56) References Cited

U.S. PATENT DOCUMENTS 4,041,780 A * 8/1977 Angehrn ..... 73/152.02
4,349,072 A 9/1982 Escaron et al.
4,485,870 A * 12/1984 Walulik ..... 166/383
4,664,189 A 5/1987 Wittrisch
4,690,214 A 9/1987 Wittrisch
4,715,446 A 12/1987 Wittrisch
5,217,075 A 6/1993 Wittrisch
6,419,013 B1 * 7/2002 Milne et al. ..... 166/254.2

FOREIGN PATENT DOCUMENTS

GB 2 344 123 5/2000

* cited by examiner

*Primary Examiner*—William Neuder
*Assistant Examiner*—Matthew J Smith
(74) *Attorney, Agent, or Firm*—Paul & Paul

(57) ABSTRACT

An apparatus and method for deploying a so-called compact battery/memory logging tool, for acquiring data in deviated or horizontal wells in the oil and gas well data logging industry. A drillpipe assembly (10) includes a drillpipe (11) having secured at a downhole end thereof a delatching latching sub (12) containing an extendable running sub (13) supporting a battery/memory logging tool (14). The running sub (13) occupies an initial, retracted position during deployment of the drillpipe (11), whereby the logging tool (14) is protected within one or more drillpipe stands. The running sub is movable by a messenger (26) to a second, extended position in which its logging tool (14) protruding from the drillpipe (11). The drillpipe assembly may therefore be used to protect the logging tool (14) during running in operations; and then to extend the logging tool permit commencement of logging operations.

32 Claims, 6 Drawing Sheets

DRILLPIPE ASSEMBLY AND A METHOD OF DEPLOYING A LOGGING TOOL

This invention relates to a drillpipe assembly for use in the logging of a borehole that perforates a geological formation. The invention also relates to a method of deploying a logging tool for the logging of such a borehole.

The logging of boreholes is technique well known in the oil and gas industries. The advantages of such an activity are well known to those skilled in the art of oil and gas production.

When a borehole is drilled, it is seldom smooth and regular. Sections of the borehole sometimes cave in. Sometimes there are other sections of rock, in particular shales and clays, that squeeze into the borehole as a result of pressure exerted by overlying strata.

Traditionally, borehole logging has involved the use of a so-called wireline logging tool. The wireline logging tool is lowered on a wireline or pushed on drillpipe into the borehole to a downhole, logging location. The wireline logging tool is connected by a wireline to eg. data processing and recording apparatus at a surface location external of the borehole.

Wireline logging tools are of comparatively large diameter. Consequently it is difficult to push or lower a wireline logging tool into a borehole having caved in or squeezed sections as aforesaid.

In recent years it has become known to employ, for the logging of boreholes, a so-called compact battery/memory logging tool. This logging tool typically is of considerably less diameter than a wireline logging tool. It includes a self-contained power supply in the form of a series of batteries; and one or more memory devices, whose function is to record data logged by the logging tool.

Battery memory logging tools in many circumstances offer advantages over traditional, wireline tools.

The deployment of a battery memory logging tool has hitherto involved securing the tool to the end of a length of drillpipe, such that the logging tool protrudes from the end of the drillpipe; and then driving the tool and drillpipe combination down the borehole, successively adding further lengths of drillpipe at the surface, and forcing the drillpipe assembly into the borehole.

This technique has been necessary because it is important for the logging tool to log the borehole in its openhole condition, ie. when there is no casing or other liner that would interfere with the accuracy of data detection and recording by the tool. Therefore it has hitherto proved necessary to advance the logging tool along the whole length of the borehole to its furthest extremity or total depth ("TD"), with the logging tool protruding from the forward-most joint of the drillpipe.

The caved in and squeezed sections of the borehole present particular hazards to the deployment of battery memory logging tools in this fashion. The protruding tool can snag and become damaged on such formations.

The caved in and squeezed sections of borehole are particularly prevalent in wells that are significantly deviated from the vertical or horizontal; and also in curved wells.

Furthermore, the likelihood of jamming or damaging a battery memory logging tool during its deployment means that logging engineers tend to deploy the tools at a comparatively slow rate, so as to minimise the risk of damage to the tools. Since rig time is often expensive oil and gas production companies wish to maximise the amount of time spent logging a borehole, as compared with deploying the logging tool. As a result there is scope for improvements in the efficiency of logging tool deployment operations.

It is an aim of the invention to overcome or at least ameliorate one or more of the disadvantages of the prior art apparatuses and methods.

According to a first aspect of the invention, there is provided a drillpipe assembly comprising a drillpipe having secured at a downhole end thereof a delatchable latching sub containing an extendible running sub supporting a logging tool, the running sub being moveable between a first, retracted position, in which it supports the logging tool within one or more stands of drillpipe; and a second, extended position in which it supports the logging tool protruding from the drillpipe, the latching sub, when latched, retaining the running sub in its first position and the latching sub permitting extending of the running sub when delatched.

The use of an apparatus that is capable of holding the logging tool retracted within a joint of drillpipe during deployment, and subsequently extending the logging tool to protrude from the drillpipe, allows deployment of the logging tool without fear that the tool will become snagged, damaged or broken off.

Furthermore, the ability to deploy the logging tool in a retracted condition allows rapid deployment over most of the travel of the logging tool along the borehole. Only at the extreme end of its travel, near the TD of the well, is it necessary to complete deployment of the logging tool at a slow rate.

As a result, the overall logging tool deployment time is significantly reduced. This in turn minimises the amount of rig time that is not used for logging operations.

In a preferred embodiment of the invention, the logging tool is a compact diameter battery memory tool. However, within the scope of the invention it is possible to devise a drillpipe assembly intended to deploy larger diameter tools than the known compact battery memory tools.

Preferably the assembly of the invention includes an hydraulic actuator for extending the running sub.

More specifically, the hydraulic actuator preferably includes one or more seals moveably sealingly interconnecting an outer periphery of the running sub and an inner wall of a drillpipe stand, whereby fluid pressure in the drillpipe acting on one side of a said seal tends to drive the running sub along the drillpipe.

Clearly while the latching sub is latched, there is resistance to movement of the running sub; but when the latching sub is delatched the hydraulic pressure acting on the seals of the running sub conveniently drives the running sub to extend from the downhole end of the drillpipe assembly.

Conveniently the or each said seal is a flexible cup seal sealingly secured to the running sub and in slideable sealing contact with the said drillpipe stand inner wall.

Flexible cup seals (also known as swab cups) are advantageously effective in providing the necessary sealing qualities. Furthermore flexible cup seals are able to accommodate changes in diameter in the internal wall of the drillpipe stand with which they engage. Consequently there is no need to maintain a constant inner diameter of the drillpipe through which the running sub is driveable.

Preferably the running sub defines a closeable fluid flow path bypassing the or each said seal, such that closing of the said path causes fluid pressure in the drillpipe to act on the or each said seal.

In preferred embodiments of the invention the drillpipe assembly includes a pumpable messenger member moveably disposed in the drillpipe. Conveniently the said fluid flow path is closeable by the messenger member.

More specifically, the running sub includes a hollow conduit that is open at either end and defines the aforesaid fluid flow path bypassing the or each said seal. The messenger member includes a sealing member and is insertable into the said conduit at a location uphole of the or each said seal to prevent the flow of fluid via the conduit, thereby closing the said fluid flow path.

Consequently the use of a running sub that includes a fluid flow path; together with a messenger member that is capable of closing the fluid flow path when inserted into the running sub, is an advantageously simple and reliable method of permitting hydraulic pressure in the drillpipe uphole of the running sub selectively to act on the seals thereof to drive the running sub forwardly of the drillpipe itself.

In a preferred embodiment of the invention the messenger member includes a shield that is moveable between a first position in which it obscures the sealing member and a second position in which the sealing member is exposed for sealing of the conduit uphole of the or each said seal of the running sub.

This arrangement advantageously ensures that the sealing member remains in good condition while the messenger member travels along the drillpipe.

Preferably the latching sub includes a member that is capable of moving the shield to its second position on insertion of the messenger member into the conduit.

This feature advantageously causes the shield to expose the sealing member when the messenger member is correctly inserted into the conduit defined in the running sub.

Preferably the latching sub includes one or more arms each pivotably secured thereto so as to be moveable between a first position, protruding outwardly from the latching sub; and a second position that is retracted relative to the first position, the drillpipe adjacent the latching sub including an abutment with which each said arm is engageable, when occupying its first position, to prevent movement of the latching sub in a downhole direction, the abutment defining a clearance through which the latching sub is moveable in a downhole direction when the or each said arm occupies its second position.

Consequently the latching sub is latched, to secure the running sub such that the logging tool is within the drillpipe, while the or each said arm occupies its first, comparatively extended position.

Once the arms retract relative to the remainder of the latching sub, the effective diameter of the latching sub is sufficiently small as to permit its passage through the clearance.

Preferably the drillpipe assembly includes a resiliently deformable biasser acting, between the or each said arm and a member that is fixed relative to the latching sub, to bias the or each said arm to its first position.

It is also preferable that the or each said arm includes a follower portion protruding into a hollow, interior part of the latching sub, the messenger member being receivable in the said hollow interior and including a surface engageable with the follower portion, on insertion of the messenger member into the hollow interior, whereby to move the or each arm to its second position.

Consequently when the messenger member engages the latching sub, the follower portion moves the or each said arm to its second position to permit delatching of the latching sub and its passage through the aforesaid clearance.

Thus the messenger member preferably carries out two functions, namely that of closing the bypass flow path so that fluid pressure acts to drive the running sub to extend the logging tool; and that of delatching the latching sub.

If desired, during design of the latching sub and messenger member the length of the messenger member may be adjusted in order to determine the order in which the aforesaid functions take place.

Preferably the latching sub and the messenger include a detent arrangement for securing the messenger member to the latching sub following engagement therebetween.

The detent arrangement ensures that, following delatching of the latching sub, the messenger member remains attached thereto. This in turn ensures that the messenger member continues effectively to close the bypass fluid flow path, throughout the deployment of the logging tool.

In a particularly preferred embodiment, the detent arrangement includes a moveable barb that is resiliently biassed to protrude into the hollow interior of the latching sub; and a notch, of complementary profile to the barb, formed in the messenger member.

This detent arrangement is advantageously reliable.

It is of course within the scope of the invention for the barb, or a functionally equivalent device, to be formed on the messenger member; and the notch to be part of the latching sub.

Conveniently the messenger member includes a cylindrical member of smaller diameter than the internal diameter of the drillpipe, the cylindrical member being encircled by one or more flexible cup seals.

This arrangement ensures that the messenger member can travel along the length of the drillpipe even if the internal diameter of the drillpipe varies from place to place.

The use of flexible cup seals additionally advantageously ensures that the messenger member is self-centring in the drillpipe. This is beneficial particularly to ensure correct engagement of the messenger member with the latching sub, in a manner described hereinbelow.

It is also preferable that the cylindrical member forming part of the messenger member is hollow and closed at at least one end.

Use of a hollow cylindrical member means that the messenger member as a whole can be manufactured as light as possible, thereby reducing the energy required to pump a messenger member along the drillpipe. Clearly however at least one end of the messenger member must be closed otherwise the flexible cup seals would be ineffective in providing pumped driving of the messenger member.

The drillpipe assembly of the invention preferably includes a mule shoe landing sub at its furthest downhole extremity, the mule shoe landing sub including an hydraulic signal generator for generating a signal, that is detectable at surface level, indicative of deployment of the logging tool.

More preferably, the mule shoe landing sub includes a mule shoe drillpipe stand having a first valve port formed therein providing fluid communication between the interior and exterior of the mule shoe drillpipe stand and being closed by a hollow valve sleeve slidingly sealingly engaged with a surface of the mule shoe drillpipe stand, the running sub preferably including a member engageable, following extension of the running sub from the latching subs with the valve sleeve, to move it to an open position of the first valve port.

Thus the running sub advantageously serves to activate a signal generator that indicates at a surface location that the logging tool that is attached to the running sub has been deployed to the TD of the well.

Conveniently the mule shoe landing sub includes a resiliently deformable biasser biassing the valve sleeve to the closed position of the first valve port.

In a particularly preferred embodiment the biasser is a spring that forces a sleeve to cover and hence close the valve port.

The biasser applies a bias pressure such as but not limited to 500 psi, such that a substantial pressure is needed to open the said first valve port. This in turn assures firstly that the mule shoe landing sub does not send a false deployment signal; and secondly that the deployment signal is easily detected, in a manner described below, at a surface location external of the well.

Conveniently the mule shoe drillpipe stand includes a second valve port located downhole of the first valve port and normally closed by the valve sleeve, whereby on further movement of the valve sleeve, away from the normally closed position of the first valve port, the second valve port opens after opening of the first valve port.

This arrangement permits the generation of successive deployment signals, thereby providing a surface-located operator with confirmation of correct deployment of the logging tool.

A preferred arrangement of the second valve port is one in which the mule shoe landing sub includes an abutment preventing movement of the valve sleeve to open the second valve port, the abutment being retained relative to the mule shoe landing sub by one or more shear fasteners that on shearing permit opening of the second valve port.

In a particularly preferred embodiment, the drillpipe pressure necessary to shear the shear fastener is greater than the pressure necessary to overcome the biasser that maintains the first valve port in its normally closed condition. This arrangement provides advantages in terms of the reading of the deployment signal at a surface location.

The invention is also considered to reside in an assembly as aforesaid, when inserted in a wellbore that includes an openhole section downhole of the assembly of the invention.

This arrangement of course allows accurate logging of the wellbore, since logging tools are designed to log openhole wells.

A further, optional feature of the drillpipe assembly of the invention is a hollow float valve sub defining a fluid flow path and located uphole of the latching sub, the float valve sub including two normally closed non-return valves that each prevent fluid overpressure in the drillpipe assembly transmitting to the surface, each said non-return valve being openable by a pumpable messenger passing in the downhole direction through the float valve sub.

This arrangement advantageously prevents fluid overpressure downhole of the float valve sub from transmitting to the surface. In other words, the float valve sub prevents downhole overpressure from blowing components of the drill string, together with the drilling mud, out of the open end of the wellbore at the surface location.

In a particularly preferred embodiment of the invention, the two non-return valves of the float valve sub are spaced apart from one another in the elongate direction of the float valve sub by a length greater than the length of a said messenger member inserted into the drillpipe assembly.

This ensures that even as the messenger member passes through the float valve sub, at no time are both the valve members of the float valve sub open.

According to a second aspect of the invention there is provided a kit of parts, for forming a drillpipe assembly according to any preceding claim, comprising:

a plurality of joints of drillpipe;

a delatchable latching sub capable of containing an extendible running sub;

a running sub that is containable in the latching sub; and a battery/memory logging tool.

Optionally the kit may further include one or more components selected from:

a pumpable messenger;

a mule shoe landing sub; and/or a float valve sub.

A kit according to the second aspect of the invention is readily dismantleable for transportation. Furthermore, the presence of a number of drillpipe joints means that the length of the drillpipe assembly may readily be adjusted to suit the depth of the well to be logged.

According to a third aspect of the invention there is provided a method of deploying a battery/memory logging tool in a wellbore, the method comprising the steps of:

(i) securing a delatchable latching sub in a drillpipe assembly;

(ii) supporting a battery/memory logging tool on an hydraulically pumpable running sub that is temporarily latchable in the latching sub;

(iii) latching the running sub in the latching sub so that the logging tool lies within a length of drillpipe;

(iv) running in a plurality of stands of drillpipe above the latching sub, until the drillpipe is of a preferred length;

(v) pumping a pumpable messenger member down the drillpipe to de-latch the latching sub and release the running sub, having the logging tool supported thereon, therefrom; and (vi) when the logging tool reaches an openhole location, commencing logging with the logging tool.

The method of the invention advantageously permits the rapid deployment of a logging tool, without any risk of the tool becoming snagged, damaged or broken as a result of encountering the aforementioned well defects.

Preferably the method includes the further step of, before securing the latching sub, (vi) securing a mule shoe landing sub at the downhole end of the drillpipe assembly; and further including the step of, after release of the running sub, (vii) engaging the running sub and the mule shoe landing sub with one another to generate one or more hydraulic signals indicative of deployment of the logging tool.

This aspect of the method of the invention ensures the generation of a positive signal indicative of correct deployment of the logging tool.

Conveniently the method includes the sub steps of, after the step (iv) of running in the plurality of stands of drillpipe, (iv)(a) withdrawing the drillpipe from the wellbore by one or more joints; and (iv)(b) removing the withdrawn stands of drillpipe thereby creating an openhole bore before releasing the logging tool.

This series of substeps ensures that a portion of the well is in the openhole condition, thereby permitting commencement of logging operations.

Following releasing of the running sub from the latching sub, the method of the invention optionally also includes the steps of (viii) withdrawing and removing each successive stand of drillpipe from the surface of the wellbore, thereby withdrawing the drillpipe assembly; and (ix) during step (viii) logging the openhole bore.

Thus the method of logging the bore inherently includes gradual removal of the components of the assembly from the bore while logging takes place.

Conveniently the step (iv) of running in a plurality of stands of drillpipe includes the further sub-steps of (iv)(c) running in the majority of the stands at a first, comparatively high speed; and, when the downhole end of the drillpipe assembly approaches the Total Depth (TD) of the well, (iv)(d) running in the remainder of the stands at a second, lower speed.

This aspect of the method permits the bulk of the deployment operation to take place at a high speed. The speed of deployment only needs to be reduced as the logging tool approaches the TD of the well.

Consequently, the method of the invention makes efficient use of the rig times.

More specifically, the step (v) of the method of the invention preferably includes the substeps of (v)(a) engaging together the messenger member and an actuator for a moveable detent member to cause disengagement of the detent member from a further member to permit releasing of the running sub; and (v)(b) closing a bypass flow of fluid whereby to divert the flow to pump the running sub in a downhole direction.

This provides a conveniently switchable, efficient method of driving or pumping the running sub along the drillpipe, for purposes of deploying the logging tool.

Preferably the substeps (v)(a) and (v)(b) occur substantially simultaneously.

As noted hereinabove, the length of the messenger member may if desired be chosen to dictate the time lag between the two said steps.

There now follows a description of a preferred embodiment of the invention, by way of non-limiting example, with reference being made to the accompanying drawings in which.

Figure 1:
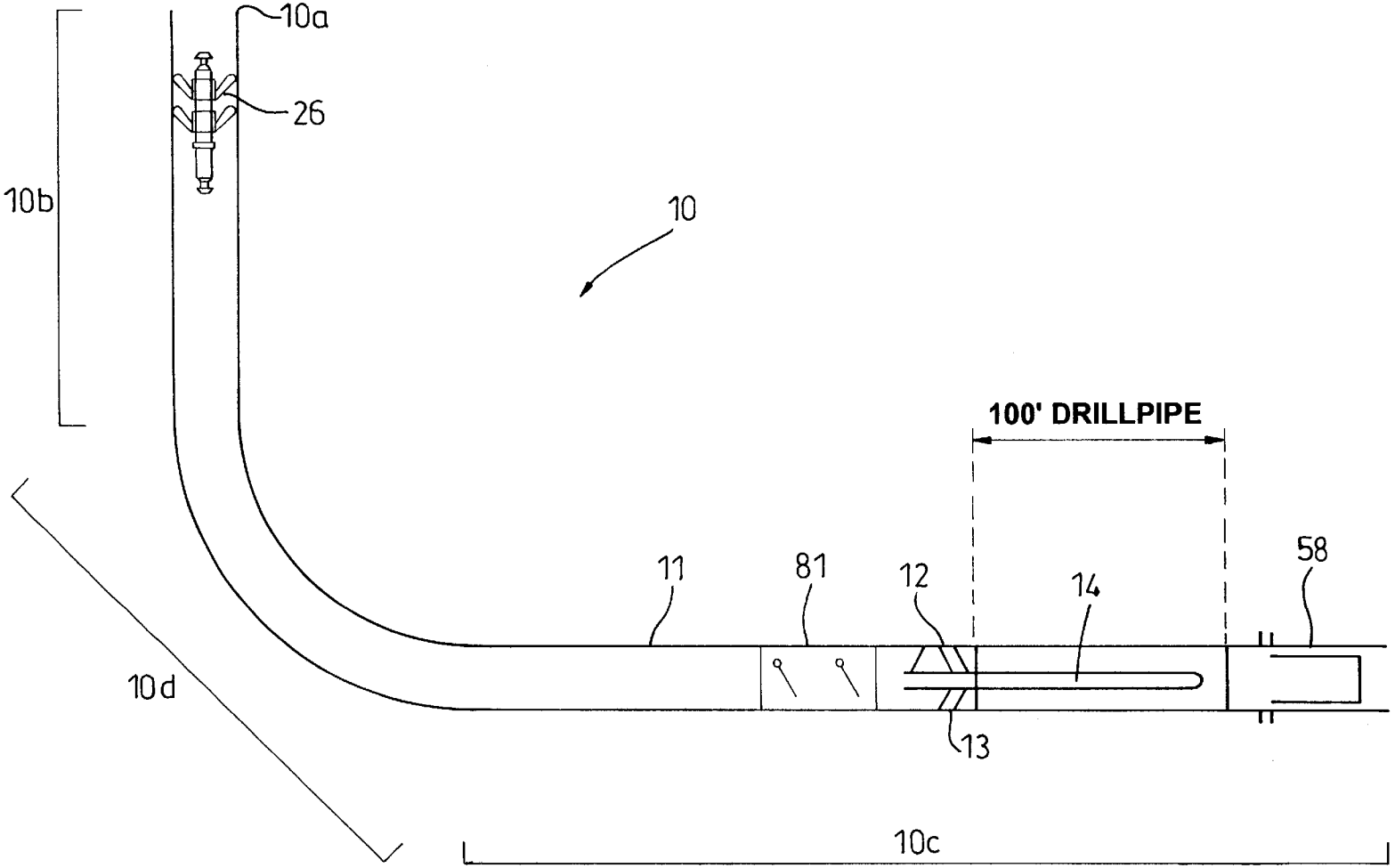
FIG. 1 is a schematic representation of a drillpipe assembly, according to the invention, installed in a wellbore.

Referring to the drawings there is shown a drillpipe assembly 10 according to the invention.

Drillpipe assembly 10 is, as is conventional in the wellbore data logging art, inserted into a wellbore after it has been drilled.

Wellbores typically include an initial, vertical portion that extends downwardly from a surface location; and for example a horizontal section that perforates a geological formation containing a valuable fluid such as oil or natural gas.

The vertical and horizontal sections of the wellbore are interconnected by a smooth curve.

The walls of the wellbore are omitted from FIG. 1 for clarity, but the drillpipe assembly 10 is shown having a shape that is substantially congruent with such a wellbore. Consequently drillpipe assembly 10 includes a surface termination 10*a* at the uppermost end of a vertical section of drillpipe 10*b*.

Vertical section 10*b* is connected to a substantially horizontal section 10*c* by virtue of a smoothly curved portion 10*d* of the drillpipe assembly.

Further references to the shape and layout of the drillpipe assembly 10 of the invention refer to the FIG. 1 arrangement just described. However it is within the scope of the invention for the drillpipe to adopt any of a number of other configurations, to suit the precise wellbore shape.

Drillpipe assembly 10 includes a drillpipe 11 having a series of so-called joints or stands of drillpipe secured seriatim to one another to define a liner for the wellbore.

Drill pipe assembly 10 includes a plurality of subs, including a delatchable latching sub 12 that is capable of housing a running sub 13 that is extendable therefrom.

Running sub 13 supports a logging tool 14 that is of the compact battery/memory type.

The running sub 13 is moveable, in a manner described in more detail hereinbelow, between a first, retracted position in which it supports the logging tool 14 within one or more stands of drillpipe 11; and a second, extended position in which it supports the logging tool 14 protruding from the drillpipe 11.

Latching sub 12, when latched, retains the running sub 13 in its first position. On delatching, the latching sub permits extension of the running sub 13 to its extended position.

Figure 2:
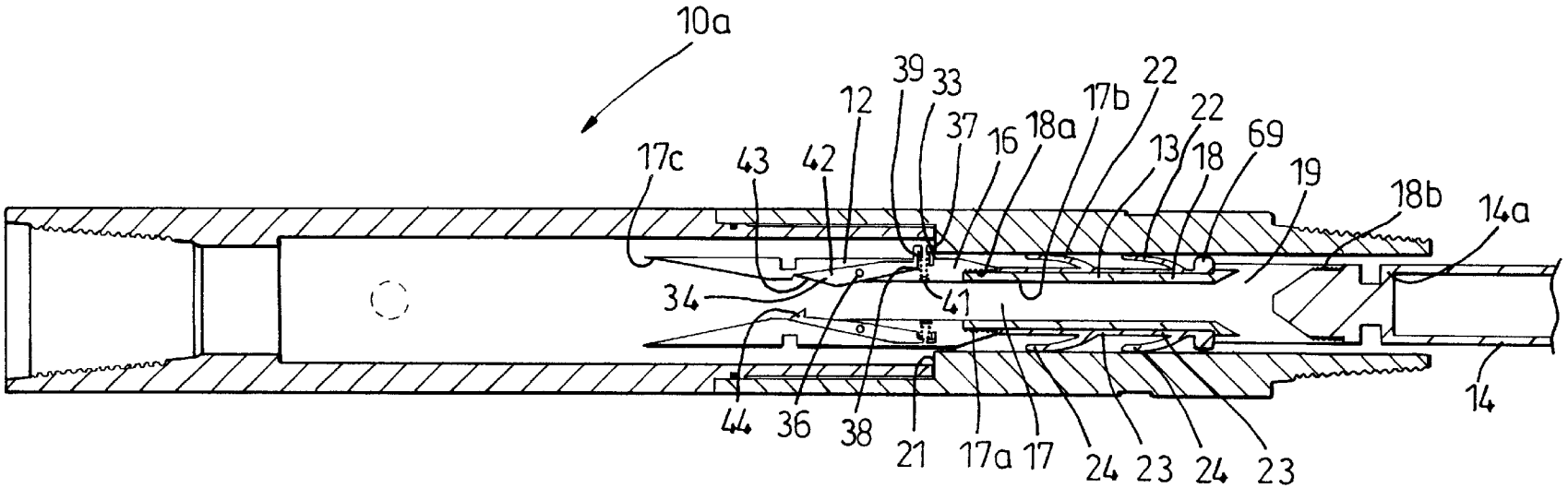
FIG. 2 shows in longitudinally sectioned view a portion of the drillpipe assembly of FIG. 1, showing in greater detail a latching and a running sub before deployment of a logging tool attached to the running sub.

The latching and running subs are shown in FIG. 2 in more detail, in the configuration in which the latching sub is latched to retain the running sub in its retracted position.

Latching sub 12 includes a generally cylindrical body 16 that is described in more detail hereinbelow.

Cylindrical body 16 is elongate and has a through-going, elongate central bore defining a fluid flow conduit 17. At its nearest-downhole end cylindrical body 16 is internally threaded at 17*a*.

Running sub 13 also includes a cylindrical body 18 that is elongate and includes a through going, elongate bore 17*b* that defines a continuation of conduit 17.

At its nearest-uphole end (ie. the left hand end of cylindrical body 18 in FIG. 2), body 18 is externally threaded at its end 18*a* adjacent member 17, with adjacent threads of the respective members 16, 18 being mutually complementary whereby the latching sub 12 and running sub 13 are threadedly connected together such that conduit 17 is continuous along the length of the conjoined bodies 16, 18.

Conduit 17 is open at its end 17*c* nearest the uphole end of the drillpipe assembly 10 (ie. the left hand end of member 17 in FIG. 2).

Conduit 17 is similarly open at the downhole end 18*b* of body 18 (ie. at the right hand end of the length of drillpipe visible in FIG. 2).

The inner surface of body 18 at end 18*b* is threaded and threadedly receives therein the uphole end 14*a* of battery memory logging tool 14.

End 14*a* of logging tool 14 closes the open end of cylindrical member 18.

A short distance uphole of end 18*b*, the outer wall of member 18 is perforated by at least one, and in practice a plurality, of fluid vents 19 that permit fluid flow from the conduit 17 to the exterior of body 18.

In the embodiment shown the vents 19 are arranged in a circular pattern about the periphery of body 18; but in practice virtually any arrangement of the vents is possible.

The length of drillpipe assembly 10 visible in FIG. 2 is constituted by a two part drillpipe stand 10*a*.

At a location approximately two thirds of the way along drillpipe stand 10*a* in the downhole direction, the inner diameter thereof reduces at a shoulder 21 that faces in the uphole direction.

The diameter of the bore in drillpipe stand 10*a* downhole of shoulder 21 is constant over the remainder of the length of the stand 10*a*, and less than the diameter of the interior bore in the immediately adjoining uphole portion.

The cylindrical bodies 16 and 18, and the logging tool 14 are all of a sufficiently small diameter as to permit their passage along the drillpipe stand via the reduced diameter portion that is downhole of shoulder 21.

Cylindrical body 18 includes secured about its outer periphery a series (in the embodiment shown two) of flexible cup seals 22 known as swab cups.

Each swab cup 22 comprises a sleeve 23 that encircles the outer periphery of the member 18; and protruding outwardly therefrom a frustoconical annular member 24 that is manufactured from a resiliently deformable material.

As shown each cone frustum defined by a said member 24 tapers towards the downhole end of the drillpipe assembly 10.

The swab cup seals 22 slidingly sealingly engage at their outer peripheries the inner surface of the drillpipe stand 10*a* such that when fluid pressure (eg. of drilling mud, etc) in the drillpipe 10 acts on the uphole side of each squab cup and there is no impediment to movement of the running sub, the running sub is pumped in a downhole direction along the drillpipe. The clearance between the outer diameter of the body 18 and the inner diameter of the drillpipe 10*a*, together with the presence of the swab cup seals 22, thus constitutes an hydraulic actuator whose primary function (that is described in more detail below) is the pumping of the running sub 13 in a downhole direction.

For this reason, the sleeve portion 23 of each swab cup seal 22 is sealingly secured about the outer periphery of cylindrical member 18.

The conduit 17 defined by the members 16 and 18, together with the vents 19 that open at a location downhole of the swab cups 22, define a closeable fluid flow path bypassing the seals 22.

The fluid flow path thus defined is normally open. It will be evident that on closing of the fluid flow path such that drilling mud cannot be pumped through the conduit 17 to exit via the vents 19, mud pressure will act on the uphole sides of the frustoconical members 24 with the result that the running sub 13 having the logging tool 14 attached thereto is driven in a downhole direction.

Since in practice, as signified by FIG. 1, drillpipe stand 10*a* will have secured at either end a plurality of further stands of drillpipe, the hydraulic actuator defined by the conduit 17 and the flexible seals 22 constitutes a means by which the logging tool 14 may be moved from an initial position, in which it is retracted within a stand of drillpipe, to an extended position in which the logging tool 14 protrudes from the drillpipe to permit logging to take place.

Figure 3:
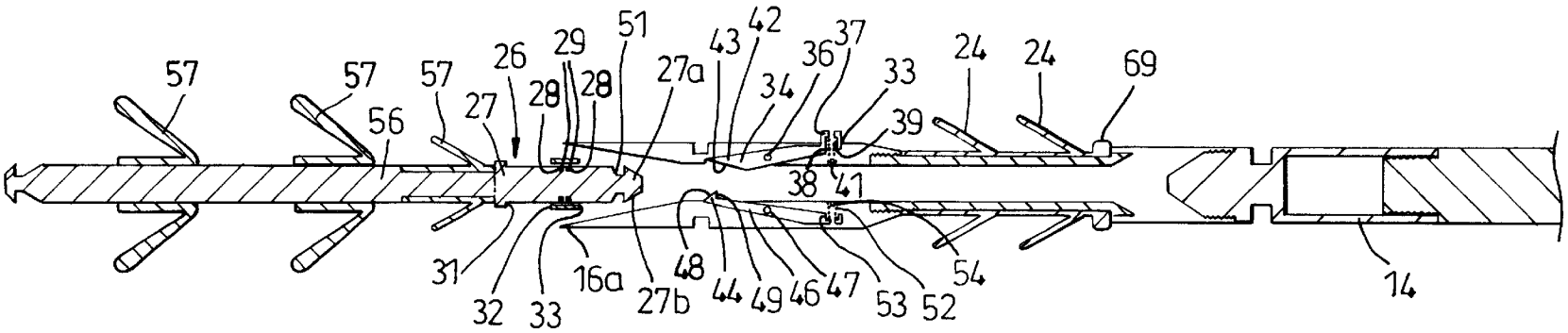
FIG. 3 shows the latching and running subs at the time of engagement thereby by a messenger member.

Closing of the fluid flow path 17 is achieved through use of a pumpable messenger member 26 shown schematically in FIG. 1 and in more detail in FIG. 3.

FIG. 3 additionally shows the components of FIG. 2 but omits the drillpipe stand 10*a* for clarity. FIG. 3 also shows the frustoconical members 24 in the extended position they adopt when acted on by drilling mud pressure in a portion of drillpipe stand of larger internal diameter than that shown in FIG. 2. Consequently the frustoconical members 24 are shown flared outwardly to a greater degree in FIG. 3 than in FIG. 2.

Messenger member 26 includes a generally cylindrical body 27.

Adjacent its forwardmost (downhole) end 27*a*, cylindrical body 27 includes a pair of peripheral grooves 28 each having seated therein an O-ring seal 29 of per se known design.

The diameter of cylindrical body 27 in this region is slightly less than that of the interior of conduit 17 defined in bodies 16 and 18. Consequently the outermost diameter of each O-ring seal 29 is sufficient to seal in conduit 17 on insertion of the forwardmost end 27*a* of messenger member 26 thereinto.

At a location spaced from the grooves 28 in the uphole direction, the diameter of cylindrical body 27 increases to present a forwardly facing annular shoulder 31.

A hollow, cylindrical sleeve 32 is slidably received on the exterior surface of cylindrical body 27, covering the O-ring seals 29.

Friction acts between the inner diameter sleeve 32 and the O-rings 29, to provide a resistive force that maintains the sleeve 32 in position, covering the O-ring seals 29, during deployment operations.

At its open, uphole end, the inner diameter of cylindrical body 16 tapers in the downhole direction from a maximum at the free end 16*a* of the body to the constant diameter that is evident at portion 17*a*.

The forwardmost edge 33 of sleeve 32 includes a chamfer that also tapers in the downhole direction.

At forwardmost portion 27*a*, cylindrical body 27 is frustoconical. It will thus be apparent that as messenger member 26 enters the hollow interior of cylindrical body 16, the frustoconical shape of portion 27*a* tends to centre the forwardmost end of messenger member 26 relative to conduit 17, by virtue of contact between the tapered outer wall of portion 27*a* and the tapered inner wall downhole of free end 16*a*.

After forwardmost portion 27*a* has entered the conduit 17, the chamfer 33 of sleeve 32 engages a portion of the tapered mouth of cylindrical member 16, at a location slightly downhole of free end 16*a*.

Such engagement slides sleeve 32 rearwardly, against the resistive force of the aforesaid friction, to expose the previously slideable O-ring seals 29.

The outermost diameter of each O-ring seal 29 is sufficient, on insertion of member 26 into body 16, to seal conduit 17 and thereby close the fluid flow path via conduit 17 and vents 19.

Referring again to FIGS. 2 and 3 the latching sub 12 includes a radial perforation 33 in its hollow cylindrical body 16 for accommodating a latching arm 34 that is pivotably secured to cylindrical body 16 at pivot point 36 that secures arm 34 in a recess formed in the wall of cylindrical body 16.

Arm 34 is moveable between first position as shown in FIG. 2, in which a portion 37 protrudes outwardly of cylindrical body 16 via perforation 33; and a second position in which portion 37 is retracted relative to the first position thereof.

When arm 34 occupies its first position, arm portion 37 protrudes sufficiently far as to engage abutment or shoulder 21 so as to prevent the latching sub 12, and hence the running sub 13 and logging tool 14, from moving in a downhole direction in the drillpipe assembly.

The abutment defined by shoulder 21 and the reduced diameter portion of drillpipe stand 10*a* downhole of shoulder 21 define a clearance through which the latching sub 12 may pass, in a downhole direction, when the arm 34 occupies its second, retracted position.

Arm 34 is biassed towards its first, extended position, by a resiliently deformable biasser in the form of spring 38.

Spring 38 is in the preferred embodiment a compression spring that acts between a recess 39 formed in the side of portion 37 nearest to conduit 17; and a seat 41 that is fixed relative to the remainder of latching sub 12 by virtue of being formed in the recess that accommodates the arm 34.

Portion 37 is shaped as shown in FIG. 2 to accommodate the cylindrical shape of spring 38, whereby spring 38 tends to push portion 37 outwardly relative to cylindrical body 16.

Arm 34 includes at its uphole end 42, that protrudes into conduit 17, a follower surface 43 that also protrudes into the interior of conduit 17.

As best shown in FIG. 3, the frustoconical, forwardmost portion 27 of messenger member 26 includes a tapered external surface 27*b* that is engageable with follower surface 43 on insertion of messenger member 26 into the hollow interior defined by conduit 17.

Engagement of surface 27*b* with surface 43 pushes arm 34 to pivot about pivot point 36, whereby the portion of arm 34 to the left of pivot point 36 in FIGS. 2 and 3 retract into the recess in cylindrical member 16 that accommodates arm 34. This causes simultaneous withdrawal of portion 37 to the retracted, second position of arm 34 with the result that latching sub 12 is then free to pass through the clearance defined by shoulder 21.

The latching sub 12 together with the messenger member 26 also include a detent arrangement for securing the messenger member 26 to the latching sub following insertion of the messenger member into the interior of latching sub 12.

The detent arrangement includes a barb 44 that as shown in FIGS. 2 and 3 is secured on a further arm 46 that is pivotably secured at a pivot point 47 in a recess formed in the wall of cylindrical member 16 so that barb 44 protrudes into the hollow interior of conduit 17.

As shown, barb 44 presents an inclined ramp surface 48 that faces towards the uphole end of conduit 17; and a shoulder 49 that faces the downhole direction.

Portion 27*a* of messenger member 27 includes, located slightly uphole of the frustoconical surface 27*b*, an annular notch 51 that is generally of complementary profile to that of barb 44.

The portion of arm 46 on the opposite side of pivot point 47 to that of barb 44 is biassed towards the outer extremity of the recess defined in the wall of cylindrical member 16, by a further spring 52 that acts between a recess 53 formed in further arm 46 and a seat 54 that is similar to the seat 41 that locates spring 38.

On insertion of messenger member 26 into the interior of latching sub 12, in addition to closing the bypass fluid flow path defined by conduit 17 and causing retraction of arm portion 37, the messenger member 26 additionally coacts with the detent defined by the barb 44 so that messenger member 26 is firmly retained relative to latching sub 12.

This arrangement confers considerable latitude on a designer of apparatus according to the invention, in terms of the timing of the various events effected by the messenger member.

For example, the length of the cylindrical body 27 of messenger member 26 may be chosen such that the O-ring seals 29 become effective to close the conduit 17 a predetermined time before frustoconical surface 27*b* engages follower surface 43.

Alternatively the arrangement could be such that frustoconical surface 27*b* engages follower surface 43 before the O-ring seals 29 close the conduit 17*a*.

Regardless of the precise order of events chosen, the detent arrangement defined by barb 44 and notch 51 is such as to retain the various components 29, 33 and 34 in their actuated positions.

The messenger member 26 includes a further, elongate cylindrical body portion 56 that lies uphole of and is rigidly secured to body portion 27.

Both the cylindrical body portions 27 and 56 defining the messenger member 26 are of smaller diameter than the drillpipe 10. Cylindrical body portion 56 is encircled by three cup seals in the form of per se known swab cups 57.

The plurality of swab cups permit pumping of the messenger member along the length of the drillpipe assembly 10 from the surface location to the latching sub, in a per se known manner that involves pumping of eg. drilling mud along the length of the drillpipe.

In the preferred embodiment of the invention, at least body portion 56 of messenger member 26 is a hollow cylinder, in order to save weight.

To permit pumping of such a cylinder along the length of the drillpipe assembly 10, the hollow cylinder must be closed at one location along its length.

Figure 4:
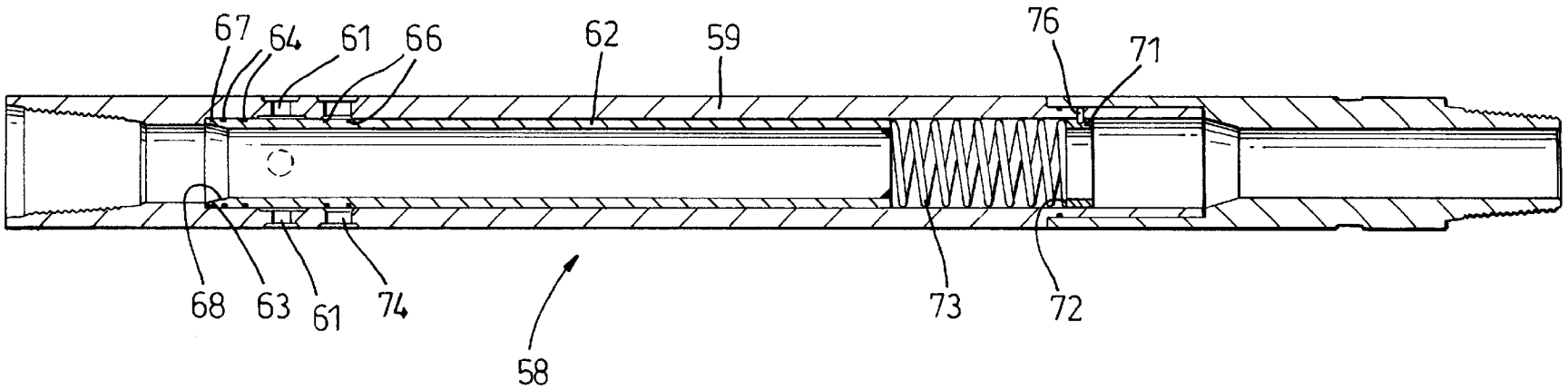
FIG. 4 shows in longitudinally sectioned view a mule shoe landing sub forming part of the drillpipe assembly of FIG. 1.

At its furthest downhole extremity (or TD), the drillpipe assembly of the invention includes a mule shoe landing sub 58 that is best shown in FIG. 4.

The main purpose of the mule shoe landing sub is to generate an hydraulic signal, that is detectable at surface level and is indicative or correct deployment of the logging tool 14. The mule shoe landing sub additionally prevents the tool 14 from exiting into the wellbore.

Mule shoe landing sub 58 includes a hollow mule shoe drillpipe stand 59 having formed therein a first valve port in the form of a series of circulating ports 61 that perforate drillpipe stand 59 at regular intervals about the periphery thereof, approximately one third of the way along the drillpipe stand when measured from its uphole end (ie. the left hand side of FIG. 4).

Since the circulating ports 61 perforate the drillpipe stand 59 they provide fluid communication between the interior and exterior thereof.

The circulating ports 61 are maintained in a normally closed position by a hollow valve sleeve 62 that is slideably received within the hollow interior of drillpipe stand 59, abutting a downhole facing annular shoulder 63 that prevents ejection of sleeve 62 from the uphole end of drillpipe stand 59.

Sleeve 62 includes encircling its outer periphery respective pairs 64, 66 of O-ring seals that permit sleeve 62 to remain in sliding, sealing engagement with the inner periphery of the interior of drillpipe stand 59.

The O-ring seal pairs 64, 66 are spaced longitudinally from one another so that when sleeve 62 occupies the initial position shown in FIG. 4 they lie to either side of the circulating ports 61, thereby maintaining them in a closed condition.

The uphole end 67 of sleeve 62 opens at a mouth defined by an inwardly tapering inner periphery 68. As best shown in FIGS. 2 and 3, the running sub 13 includes extending about its outer periphery a short distance from its right hand end as viewed in FIGS. 2 and 3 an annular landing collar 69 that protrudes radially outwardly of the cylindrical body 18 a short distance downhole of the swab cups 22 described hereinabove.

Following deployment of the logging tool 14 through operation of the messenger member 26 and the latching sub 12, the right hand end of cylindrical member 18 as viewed enters the tapered mouth 68 of sleeve 62 such that landing collar 69 firmly engages sleeve 62.

Mule shoe landing sub 58 includes part way along its length and within its hollow interior a thrust collar 71 that presents an uphole-directed shoulder 72 against which rests one end of a compression spring 73.

The other end of spring 73 abuts the downhole end of sleeve 62.

Thus spring 73 constitutes a resiliently deformable biasser biassing the valve sleeve to the closed position of the valve port 61.

The force of spring 73 will in the preferred embodiment increase the circulating mud pressure by 500 psi as ports 61 open.

In use the running sub 13 is capable of exerting, via the landing collar 69, a sufficient force on the uphole end of sleeve 62 to overcome the force of spring 73, if the logging tool has deployed correctly (ie. the tool 14 has passed through the mule shoe landing sub sufficiently far that the landing collar engages mouth 68 and drives sleeve 62 in a downhole direction against the biassing force of spring 73).

This action causes movement of sleeve 62 to the open position of circulating ports 61, with the result that an increase in drilling mud pressure of approximately 500 psi is detectable at the surface location by virtue of connection of the restriction represented by the circulating ports 61. This is an indication of the first stage of deployment of the logging tool.

Since the segmented landing collar 69 is downhole of the swab cups 22 that drive the drilling sub, a subsequent increase in the rate of pumping of mud uphole of the running sub 13 causes the uphole pressure to continue to rise after opening of the valve ports 61.

The mule shoe drillpipe stand 59 therefore includes a second set of circulating valve ports 74 that are similar to the valve ports 61.

The second valve ports 74 are downhole of the first valve ports 61 and are normally closed by the sleeve 62. Opening of the second valve port 74 occurs only on further (secondary) movement of the valve sleeve in the downhole direction.

The thrust collar 71 is retained relative to the mule shoe drillpipe stand 59 by virtue of one more shear pins 76 that rigidly interconnect the thrust collar 71 and the drillpipe stand 59.

In the embodiment shown the shear pins 76 are rated at a differential pressure of 1000 psi. As pressure builds uphole of the swab cups 22 of the running sub 13 following initial movement of sleeve 62, the shear pins 76 will resist the tendency of the running sub 13 to drive the sleeve 62 further in a downhole direction until the mud pressure uphole of the squab cups 22 exceeds 1000 psi. At this time the shear pins 76 will shear, thereby freeing the thrust collar 71 and permitting further downhole movement of sleeve 62.

This uncovers the second circulating ports 74, with the result that a second, higher pressure (approximately 1000 psi) mud pulse is transmitted via the interior of the drillpipe assembly to the surface location.

Figure 5:
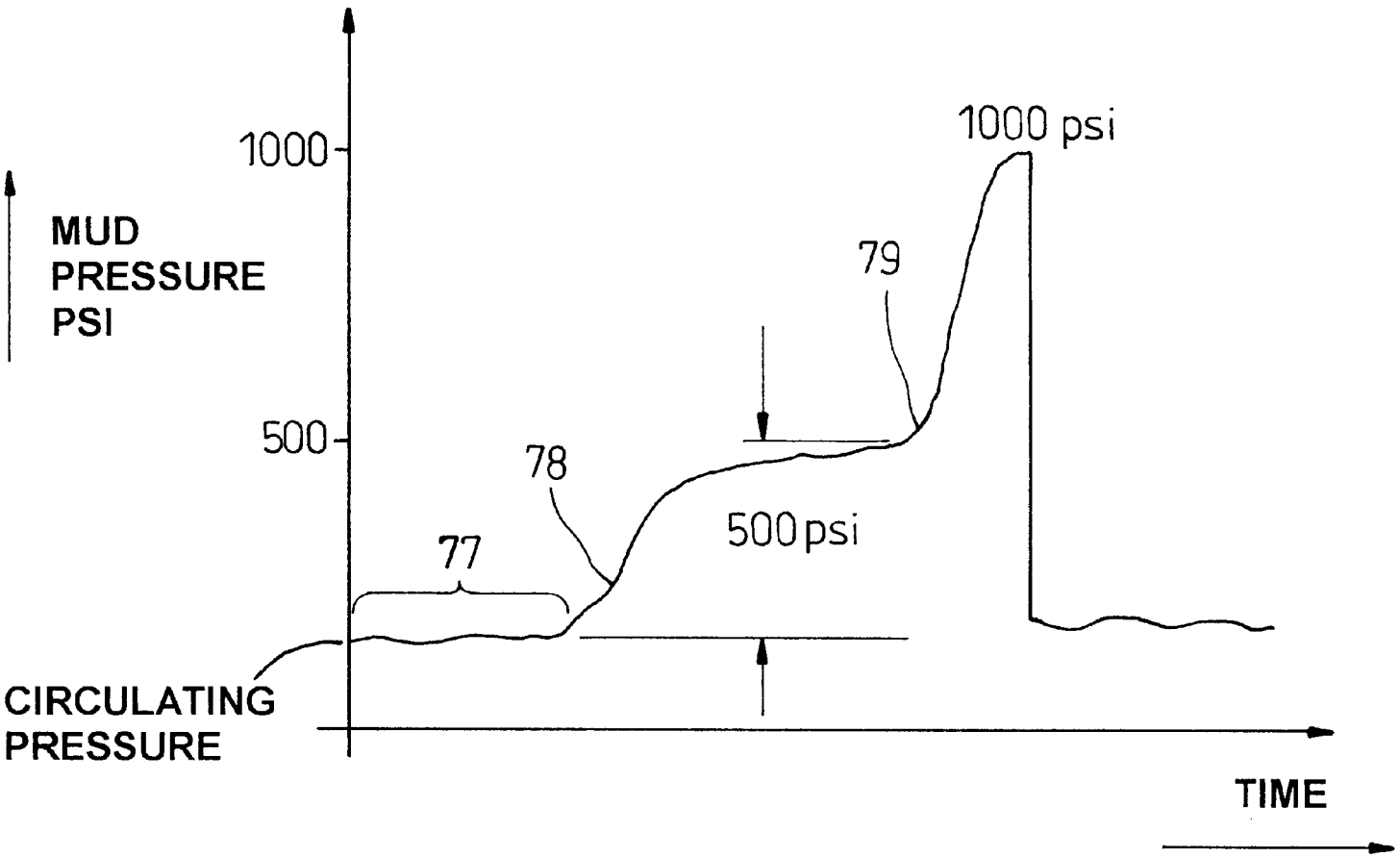
FIG. 5 is a graph showing a typical output signal of the mule shoe landing sub that is detectable at a surface location.

FIG. 5 is a plot of the mud pressure pulse signals that are detectable at the surface location.

Figure 6:
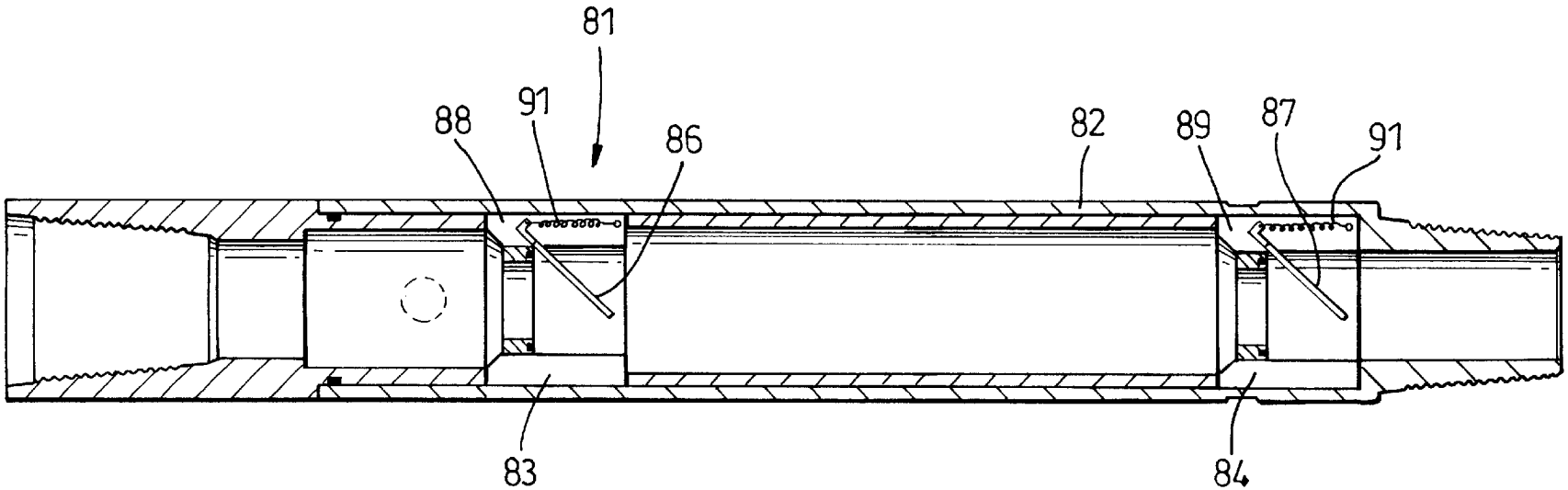
FIG. 6 is a longitudinally sectioned view of float valve sub forming part of the drillpipe assembly of the invention.

The x axis of FIG. 6 indicates mud pressure in psi; and the y axis time.

Before deployment of the logging tool 14, in zone 77 of FIG. 6, the mud pressure detectable at the surface is substantially constant and equivalent to the circulating pressure of the well.

Point 78 indicates initial deployment of the logging tool, at which time landing collar 69 drives sleeve 62 in the downhole direction thereby causing a pressure increase of 500 psi indicating initial deployment of tool 14.

Thereafter, at 79, the uphole pressure acting on the swab cups 22 rises to 1000 psi at which point the shear pins 76 shear and generate a second, higher pressure pulse that is also detectable at the surface.

Following generation of the second pressure pulse, the detected pressure decays rapidly to return to that of the circulating pressure following equalisation of pressures within and outside the drillpipe assembly in the wellbore.

Thus the mule shoe landing sub of the drillpipe assembly of the invention conveniently provides a two stage indication of correct deployment of the logging tool 14. This arrangement advantageously minimises the risk of false deployment readings.

In addition the mule shoe landing sub conveniently allows drillpipe fluid to drain into the well as the drillpipe is pulled from the well.

Referring now to FIG. 6 there is shown a float valve sub 81 that as shown schematically in FIG. 1 forms part of the drillpipe assembly 10 uphole of the latching sub 12.

Float valve sub 81 includes a substantially conventional hollow drillpipe stand 82 that defines a fluid flow path.

Float valve sub 81 includes secured within its hollow interior a pair 83, 84 of normally closed on-return valves.

The purpose of each non-return valve is to prevent downhole fluid overpressure (caused for example by perforation of a high pressure gas formation) in the drillpipe assembly transmitting to the surface location and causing a blow out.

The structure of each non-return valve 83, 84 is such as to permit it to be openable by the pumpable messenger 26 as it passes in the downhole direction through the float valve sub 81.

This is achieved by virtue of each valve 83, 84 including a respective flap valve member 86, 87 that is pivotable between a position occupying the entire cross section of the interior of the drillpipe stand 82 in the vicinity of the associated valve; and an open position in which the flap valve member lies substantially parallel to the interior wall of the drillpipe stand 82.

Each flap valve member 86, 87 is pivotably secured at an upper end to a respective collar 88, 89 forming part of each non-return valve assembly 83, 84. As shown, the location of each pivot is such that the flap valve members 86, 87 open in a downhole direction, whereby the messenger member 26 is capable of pushing the flap valve members 86, 87 to their open positions.

It follows from this that any downhole pressure acting on the flap valve members 86, 87 tends to force them towards their closed positions thereby preventing transmission of pressure to the surface location.

Each flap valve member 86, 87 is biassed to its closed position by a tension spring 91 that in FIG. 7 is shown in an exemplary location.

The non-return valve 83, 84 are spaced apart from one another in the elongate direction of the float valve sub 81, by a length that is greater than the length of the messenger member 26. As a result, at least one of the flap valve members 86, 87 is closed at all times even while the messenger member 26 passes through float valve sub 81.

It will be appreciated that the apparatus of the invention confers great flexibility on the operations of logging engineers. Such workers may select the precise number of drillpipe stands, etc. needed to assemble the drillpipe assembly as shown in FIG. 1 to a working condition. Consequently the invention additionally resides in a kit of parts comprising at least the drillpipe joints 11, the latching sub 12, the running sub 13, the messenger 26 and the logging tool 14 as defined herein. The kit may in addition optionally include the mule shoe landing sub 58 and the float valve sub 81.

In use of the drillpipe assembly of the invention, a logging engineer would first secure the battery memory logging tool 14 and the running sub 13 to the cylindrical body 16 defining part of the latching sub 12. He would then secure the latching sub 12 and the attached components in a drillpipe stand 10*a* of the kind shown in FIG. 2. This can readily be achieved by dropping the latching sub from the uphole towards to the downhole end of the drillpipe stand, whereby the latch member 37 engages the shoulder 31.

Thereafter the logging engineer would run in a plurality of stands of drillpipe above the latching sub 12, until the drillpipe is of the preferred length for logging the total depth of the wellbore. This operation optionally may include running in a float valve sub 81 as desired above the latching sub 12.

During running in of the drillpipe stands 11, the majority of the stands are run in at a high rate. Only when the end of the drillpipe assembly 10 approaches the TD of the well does the rate of running in reduce, to provide for final positioning of the drillpipe assembly. These aspects of the method are possible only because of the ability of the assembly of the invention to shield the logging tool 14 during fast running in of the drillpipe stands.

During the fast running in the logging engineer records the length of drillpipe run in, so that he may gauge when the downhole end of the drillpipe assembly 10 approaches the TD of the well.

Once the drillpipe assembly has been fully run in, the logging engineer would then pump a pumpable messenger member 26 down the drillpipe 11 to delatch the latching sub 12 and release the running sub 13 in the manner described herein. This causes deployment of the logging tool 14. During this operation the engineer records the volume of fluid pumped (eg. by counting, using a per se known counter, the number of strokes of the drilling mud pump) so that he may gauge the location of the messenger in the drillpipe.

Operation of the logging tool would commence once it reaches an openhole location. This may be signified through use of a mule shoe landing sub 58 as described herein.

Consequently operation of the invention optionally may include, before securing the latching sub, securing a mule shoe landing sub 58 at the downhole end of the drillpipe assembly; and subsequently engaging the running sub 13 and the mule shoe landing sub 58 with one another to generate preferably a plurality of hydraulic signals at the surface indicative of deployment of the logging tool 14.

The creation of an openhole section of the wellbore may be achieved by, after the step of running in the plurality of stands of drillpipe, withdrawing the drillpipe from the wellbore by one or more joints and removing the withdrawn stands of drillpipe thereby creating an openhole bore at a downhole location. This operation would take place before delatching of the latching sub 12.

During logging operations, following releasing of the running sub from the latching sub, the method of operation of the apparatus includes withdrawing and removing each successive stand of drillpipe from the uphole end of the wellbore, thereby withdrawing the drillpipe assembly and permitting the logging tool 14 to log the entire openhole bore.

What is claimed is:

1. A drillpipe assembly comprising a drillpipe having secured at a downhole end thereof a delatchable latching sub containing an extendible running sub supporting a logging tool, the running sub being moveable between a first, retracted position, in which it supports the logging tool within one or more stands of drillpipe; and a second, extended position in which it supports the logging tool protruding from the drillpipe, the latching sub, when latched, retaining the running sub in its first position and the latching sub permitting extending of the running sub when delatched, wherein the logging tool is a compact diameter battery/memory tool, including an hydraulic actuator for extending the running sub wherein the hydraulic actuator includes one or more seals moveably sealingly interconnecting an outer periphery of the running sub and an inner wall of a drillpipe stand, whereby fluid pressure in the drillpipe acting on one side of a said seal tends to drive the running sub along the drillpipe.

2. A drillpipe assembly according to claim 1 wherein the or each said seal is a flexible cup seal sealingly secured to the running sub and in slideable sealing contact with the said drillpipe stand inner wall.

3. A drillpipe assembly according to claim 1, wherein the running sub defines a closeable fluid flow path bypassing the or each said seal, closing of the said path causing fluid pressure in the drillpipe to act on the or each said seal.

4. A drillpipe assembly according to claim 3, including a pumpable messenger member moveably disposed in the drillpipe.

5. A drillpipe assembly according to claim 1, wherein the said fluid flow path is closeable by the messenger member.

6. A drillpipe assembly according to claim 5 wherein the running sub includes a hollow conduit that is open at either end and defines the fluid flow path bypassing the or each said seal, the messenger member including a sealing member and being insertable into the said conduit at a location uphole of the or each said seal to prevent the flow of fluid via the conduit, thereby closing the said fluid flow path.

7. A drillpipe assembly according to claim 6 wherein the messenger member includes a shield that is moveable between a first position in which it obscures the sealing member and a second position in which the sealing member is exposed for sealing of the conduit uphole of the or each said seal of the running sub.

8. A drillpipe assembly according to claim 7 wherein the latching sub includes a member that moves the shield to its second position on insertion of the messenger member into the conduit.

9. A drillpipe assembly according to claim 4, wherein the latching sub and the messenger member include a detent arrangement for securing the messenger member to the latching sub following engagement therebetween.

10. A drillpipe assembly according to claim 9, wherein the detent arrangement includes a barb formed on part of an arm that is pivotably secured on the latching sub so that the barb protrudes into a hollow interior part of the latching sub; and a notch, of complementary profile to the barb, formed in the messenger member.

11. A drillpipe assembly according to claim 4, wherein the messenger member includes a cylindrical member of smaller diameter than the internal diameter of the drillpipe, the cylindrical member being encircled by one or more cup seals.

12. A drillpipe assembly according to claim 4, wherein the cylindrical member is hollow and closed at at least one end.

13. A drillpipe assembly according to claim 1 wherein the latching sub includes one or more arms each pivotably secured thereto so as to be moveable between a first position, protruding outwardly from the latching sub; and a second position that is retracted relative to the first position, the drillpipe adjacent the latching sub including an abutment with which each said arm is engageable, when occupying its first position, to prevent movement of the latching sub in a downhole direction, the abutment defining a clearance through which the latching sub is moveable in a downhole direction when the or each said arm occupies its second position.

14. A drillpipe assembly according to claim 5 including a resilient deformable biasser acting, between the or each said arm and a member that is fixed relative to the latching sub, to bias the or each said arm to its first position.

15. A drillpipe assembly according to claim 13, wherein the or each said arm includes a follower portion protruding into a hollow, interior part of the latching sub, the messenger member being receivable in the said hollow interior and including a surface engageable with the follower portion, on insertion of the messenger member into the hollow interior, whereby to move the or each arm to its second position.

16. A drillpipe assembly according to claim 1, inserted in a wellbore that includes an openhole section downhole of the said latching sub.

17. A drillpipe assembly according to claim 4 including a hollow float valve sub defining a fluid flow path and located uphole of the latching sub, the float valve sub including two normally closed non-return valves that each prevent fluid overpressure in the drillpipe assembly transmitting to the surface, each said non-return valve being openable by a pumpable messenger passing in the downhole direction through the float valve sub.

18. A drillpipe assembly according to claim 17, wherein the two non-return valves are spaced apart from one another in the elongate direction of the float valve sub, by a length greater than the length of a messenger member inserted into the drillpipe assembly.

19. A drillpipe assembly comprising a drillpipe having secured at a downhole end thereof a delatchable latching sub containing an extendible running sub supporting a logging tool, the running sub being moveable between a first, retracted position, in which it supports the logging tool within one or more stands of drillpipe; and a second, extended position in which it supports the logging tool protruding from the drillpipe, the latching sub, when latched, retaining the running sub in its first position and the latching sub permitting extending of the running sub when delatched, the logging tool being a compact diameter battery/memory tool, and the drill pipe assembly further including a mule shoe landing sub at its furthest downhole extremity, the mule shoe landing sub including an hydraulic signal generator for generating a signal, that is detectable at surface level, indicative of deployment of the logging tool.

20. A drillpipe assembly according to claim 19 wherein the mule shoe landing sub includes a mule shoe drillpipe stand, having a first valve port formed therein providing fluid communication between the interior and exterior of the mule shoe drillpipe stand, and being maintained normally closed by a hollow valve sleeve slidingly sealingly engaged with a surface of the mule shoe drillpipe stand; and wherein the running sub includes a member engageable, on protrusion of the running sub, with the valve sleeve to move it to an open position of the first valve port.

21. A drillpipe assembly according to claim 20 wherein the mule shoe landing sub includes a resilient deformable biasser biassing the valve sleeve to the closed position of the first valve port.

22. A drillpipe assembly according to claim 20 or claim 21, wherein the mule shoe drillpipe stand includes a second valve port located downhole of the first valve port and normally closed by the valve sleeve, whereby on further movement of the valve sleeve, away from the normally closed position of the first valve port, the second valve port opens after opening of the first valve port.

23. A drillpipe assembly according to claim 22 wherein the mule shoe landing sub includes an abutment preventing movement of the valve sleeve to open the second valve port, the abutment being retained relative to the mule shoe landing sub by one or more shear fasteners that on shearing permit opening of the second valve port.

24. A kit of parts, forming a drillpipe assembly according to any of claims 1–21 and 23–18, comprising:

a plurality of joints of drillpipe;

a delatchable latching sub capable of containing an extendible running sub:

a pumpable messenger member;

a running sub that is containable in the latching sub; and a battery/memory logging tool;

wherein said kit further includes one or more components selected from:

a mule shoe landing sub; and/or a float valve sub.

25. A method of deploying a battery/memory logging tool in a wellbore, the method comprising the steps of:

(i) securing a delatchable latching sub in a drillpipe assembly;

(ii) supporting a battery/memory logging tool on an hydraulically pumpable running sub that is temporarily latchable in the latching sub;

(iii) latching the running sub in the latching sub so that the logging tool lies within a length of drillpipe;

(iv) running in a plurality of stands of drillpipe above the latching sub, until the drillpipe is of a preferred length;

(v) pumping a pumpable messenger member down the drillpipe to de-latch the latching sub and release the running sub, having the logging tool supported thereon, therefrom and (vi) when the logging tool reaches an openhole location, commencing logging with the logging tool.

26. A method according to claim 25 including the further step of, before securing the latching sub, (vi) securing a mule shoe landing sub at the downhole end of the drillpipe assembly; and further including the step of, after release of the running sub, (vii) engaging the running sub and the mule shoe landing sub with one another to generate one or more hydraulic signals indicative of deployment of the logging tool.

27. A method according to claim 25 or claim 26 including the sub-steps of, after the step (iv) running in the plurality of stands of drillpipe, (iv)(a) withdrawing the drillpipe from the wellbore by one or more joints; and (iv)(b) removing the withdrawn stands of drillpipe thereby creating an openhole bore before releasing the logging tool.

28. A method according to claim 25 including the further steps of, after releasing the running sub from the latching sub, (viii) withdrawing and removing each successive stand of drillpipe from the surface of the wellbore, thereby withdrawing the drillpipe assembly; and (ix) during step (viii), logging the openhole bore.

29. A method according to claims 25, wherein the step (iv) of running in a plurality of stands of drillpipe includes the further sub-steps of (iv)(c) running in the majority of the stands at a first, comparatively high speed; and, when the downhole end of the drillpipe assembly approaches the Total Depth (TD) of the well, (iv)(d) running in the remainder of the stands at a second, lower speed.

30. A method according to claim 29 including the sub-step of (iv)(e) measuring the length of drillpipe run in during step (iv), in order to gauge when the downhole end of the drillpipe assembly approaches the TD of the well.

31. A method according to claims 25, wherein the step (v) includes the sub-steps of;

(v)(a) engaging together the messenger member and an actuator for a moveable detent member to cause disengagement of the detent member from a further member to permit releasing of the running sub; and (v)(b) closing a bypass flow of fluid whereby to divert the flow to pump the running sub in a downhole direction.

32. A method according to claim 31 wherein the sub-steps (v)(a) and (v)(b) occur substantially simultaneously.

* * * * *

UNITED STATES PATENT AND TRADEMARK OFFICE

CERTIFICATE OF CORRECTION

PATENT NO. : 6,755,257 B2
DATED : June 29, 2004
INVENTOR(S) : Michael Charles Spencer et al.

It is certified that error appears in the above-identified patent and that said Letters Patent is hereby corrected as shown below:

Title page,
Item [75], Inventors, replace "Michael John Chaplain" with
-- Michael John Chaplin --;

Column 9,
Line 11, replace "squab cup" with -- swab cup --;

Column 12,
Line 9, replace "indicative or correct deployment" with -- indicative of correct deployment --;

Column 13,
Line 31, replace "squab cups 22" with -- swab cups 22 --;

Column 14,
Line 4, replace "on-return valves" with -- non-return valves --;

Column 16,
Line 6, replace "according to claim 1" with -- according to claim 4 --;
Line 54, replace "according to claim 5" with -- according to claim 13 --;
Line 59, delete "the or";

Column 17,
Line 1, replace "according to claim 4" with -- according to claim 1 --; and
Line 58, replace "to any of claims 1-21 and 23-18" with -- to any of claims 1-18 and 20-23 --.

Signed and Sealed this

Twenty-fourth Day of August, 2004

JON W. DUDAS
*Director of the United States Patent and Trademark Office*